US007310834B2

(12) United States Patent
Karhumaki

(10) Patent No.: US 7,310,834 B2
(45) Date of Patent: Dec. 25, 2007

(54) TUB ARRANGEMENT

(76) Inventor: Jorma Karhumaki, Partola-Keskus, FI-3390 Pirkkala (FI)

( * ) Notice: Subject to any disclaimer, the term of this patent is extended or adjusted under 35 U.S.C. 154(b) by 95 days.

(21) Appl. No.: 10/503,451

(22) PCT Filed: Feb. 5, 2003

(86) PCT No.: PCT/FI03/00092

§ 371 (c)(1),
(2), (4) Date: Aug. 3, 2004

(87) PCT Pub. No.: WO03/065863

PCT Pub. Date: Aug. 14, 2003

(65) Prior Publication Data

US 2005/0081289 A1 Apr. 21, 2005

(30) Foreign Application Priority Data

Feb. 5, 2002 (FI) ..... 20020046 U

(51) Int. Cl.
*A47K 3/022* (2006.01)

(52) U.S. Cl. ..... 4/540

(58) Field of Classification Search ..... 4/540
See application file for complete search history.

(56) References Cited

U.S. PATENT DOCUMENTS 3,827,087 A 8/1974 Cuthbertson
3,924,278 A 12/1975 Ekman
4,530,121 A * 7/1985 Penney ..... 4/540
6,076,203 A * 6/2000 Karhumaki ..... 4/533

FOREIGN PATENT DOCUMENTS

| | | |
|---|---|---|
| DE | 2431651 | 1/1975 |
| EP | 0 284 644 | 10/1988 |
| FI | 97272 | 11/1996 |
| GB | 2029211 | 3/1980 |
| GB | 2309898 | 8/1997 |
| SE | 458415 | 4/1989 |
| SE | 503252 | 4/1996 |
| WO | WO03/065863 | 8/2003 |

* cited by examiner

*Primary Examiner*—Charlos E. Phillips
(74) *Attorney, Agent, or Firm*—Rodgers & Rodgers

(57) ABSTRACT

A tub arrangement comprising leg sections (2*a*, 2*b*) and/or supporting arrangement (12, 13) for fixing the arrangement on a wall or an a inner wall of a closet, wherein at least one supporting means comprise against a floor placed legs (2*b*), wherein wheels (4*b*, 4*c*); (4*d*, 4*e*) have been connected to said legs at a two part tub (1), to which one (2*b*) of the leg sections is fixed and which comprises a separate seat section (1*a*) and correspondingly a separate foot section (1*b*), the tub being turnable around a horizontal axis so that a person taking a bath can either lie or sit in the tub (1). The arrangement comprises a power element (6) connected between the leg sections (2*a*, 2*b*) or between leg section (2*b*) and supporting arrangement (12, 13) for adjusting t a first connecting point (7) and a second connecting point (8).

2 Claims, 3 Drawing Sheets

TUB ARRANGEMENT

BACKGROUND OF THE INVENTION

The invention relates to a tub arrangement comprising leg sections coupled together by hinges for bending the leg sections around the hinges, the leg sections being connected to wheels and a two-part tub, to which one of the leg sections is fixed and which comprises a separate seat section and correspondingly a separate foot section, the tub being turnable around a horizontal axis so that a person taking a bath can either lie or sit in the tub.

The prior art teaches different manners of using a tub for bathing. Finnish Patent 97,272 discloses a tub arrangement with a two-part tub. The two-part tub consists of a seat section and a foot section and it is mounted on a leg section provided with hinges and wheels. The leg section can be bent around the hinges, so that the tub can be positioned either in a horizontal position or in a seating position. A drawback of such an arrangement is that when the tub is being changed from one position to another, the tub arrangement moves on the push surface where it is located due to the wheels of the leg section, thus requiring at least two people to change the position of the tub. Furthermore, if the tub is at least partly filled with liquid and there is a person bathing in the tub, changing the position of the tub requires strenuous efforts.

BRIEF DESCRIPTION OF THE INVENTION

An objective of the present invention is to provide a tub arrangement with none of the aforementioned drawbacks.

A tub arrangement according to the invention is characterized in that the arrangement comprises a power element connected to the leg sections for adjusting the distance between a first connecting point and a second connecting point.

According to a basic idea of the invention, one of the wheel pairs arranged in the leg section of the tub arrangement is locked into a non-rotating position, so that when the distance between the connecting points is adjusted by means of the power element, the position of the tub can be changed in a small space.

An advantage of the tub arrangement according to the invention is that the tub can be easily changed from one position to another, and the tub remains substantially in place on the floor. Another advantage of the tub arrangement according to the invention is that when the tub is installed in the sitting position, it requires only a little space and it is easy to step into the tub for a bath. This is particularly useful when disabled or elderly people utilize the tub arrangement.

A tub arrangement according to one embodiment of the invention is further characterized in that one sections of the leg/supporting sections comprise a legs positioned against the floor, wherein a supporting arrangement to the wall, as closet wall, is working as the other leg sections, which arrangement comprising a rail fitted on the wall on which rail a roll or like fixed to the tub moves for turning the tub around its horizontal axis.

BRIEF DESCRIPTION OF THE FIGURES

The invention will be described in more detail below with reference to the accompanying drawings, in which.

For the sake of clarity, the figures show the invention in a simplified manner. Like reference numerals refer to like parts in the figures.

DETAILED DESCRIPTION OF THE INVENTION

Figure 1:
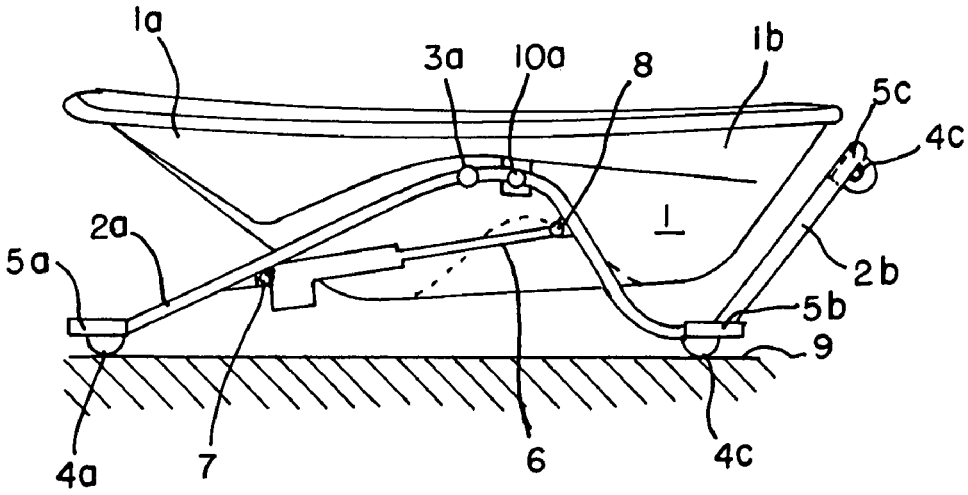
FIG. 1 is a schematic side view of a tub arrangement according to the invention in a horizontal position.

FIG. 1 is a schematic side view of a tub arrangement according to the invention in a horizontal position, the tub arrangement comprising a tub 1 with a seat section 1*a* and a foot section 1*b*. Between the seat section 1*a* and the foot section 1*b*, the bottom of the tub rises to such an extent that in the horizontal position of the tub the sections constitute clearly separate parts of the tub, yet if desired, a person bathing in the tub can covered by water or some other liquid up to his/her neck. The bottom of the seat section 1*a* is provided with a drainage duct for the seat section, which is not shown in the figures, and correspondingly, the bottom of the foot section 1*b* is provided with a drainage duct for the foot section, not shown in the figures, either. Liquid can be discharged from the tub 1 via these ducts. The bottom and the sides of the tub are also provided with feed ducts not shown in FIG. 1 for feeding liquid, such as water, or gas, such as steam, at a high pressure either in a continuous or pulse-like flow. The placement and number of the feed ducts in each section 1*a* and 1*b* of the tub can vary, i.e. the liquid or gas can be fed into the tub 1 via the feed ducts of either the seat section 1*a* or the foot section 1*b*, or if desired, via the feed ducts of both sections.

The tub arrangement comprises a tub 1 and a leg section, which consists of a leg section 2*a* on the side of the seat section 1*a*, a leg section 2*b* on the side of the foot section 1*b*, hinges 3*a* and 3*b* for coupling the leg sections 2*a* and 2*b* together, wheels 4*a* of the leg section 2*a* of the seat section 1*a*, and wheels 4*b* of the leg section 2*b* of the foot section 1*b*. The tub 1 is firmly fastened to leg section 2*b* by fastening means 10*a* and 10*b*, so that the tub 1 is substantially immovable with respect to leg section 2*b* irrespective of whether the tub 1 is in the sitting or the horizontal position. The pairs of wheels 4*a* and 4*b* are arranged in the leg sections 2*a* and 2*b* such that in the sitting position the centre of gravity of the tub arrangement with respect to the push surface 9 is located in such a manner that the tub will not keel over irrespective of whether it is empty or filled with liquid. The leg section 2*a* on the side of the seat section 1*a* is connected by a power element 6 to the leg section 2*b* on the side of the foot section 1*b* at connecting points 7 and 8. The power element 6 can be for example a piston-type cylinder, where the length of stroke is controlled for example hydraulically or pneumatically. The essential fact is that the power element 6 controls the distance between the first connecting point 7 and the second connecting point 8. The wheels 4*a* and 4*b* are provided with locking mechanisms 5*a* and 5*b* for locking the wheels 4*a*, 4*b* into a non-rotating position. The wheels 4*b*, the locking mechanisms 5*b*, the hinge 3*b* and the fastening means 10*b* will be shown below in FIGS. 3*a*, 3*b* and 3*c*. The locking mechanisms 5*a* and 5*b* of the wheels 4*a* and 4*b* for locking the wheels into a non-rotating position either mechanically, electrically or pneumatically are known per se to a person skilled in the art, wherefore the structure and operation thereof will not be described in more detail herein. The leg sections 2*a* and 2*b* can be bent around the hinges 3*a* and 3*b*, so that the tub 1 can be placed either in the horizontal position shown in FIG. 1 or in the sitting position shown in FIG. 2.

Figure 2:
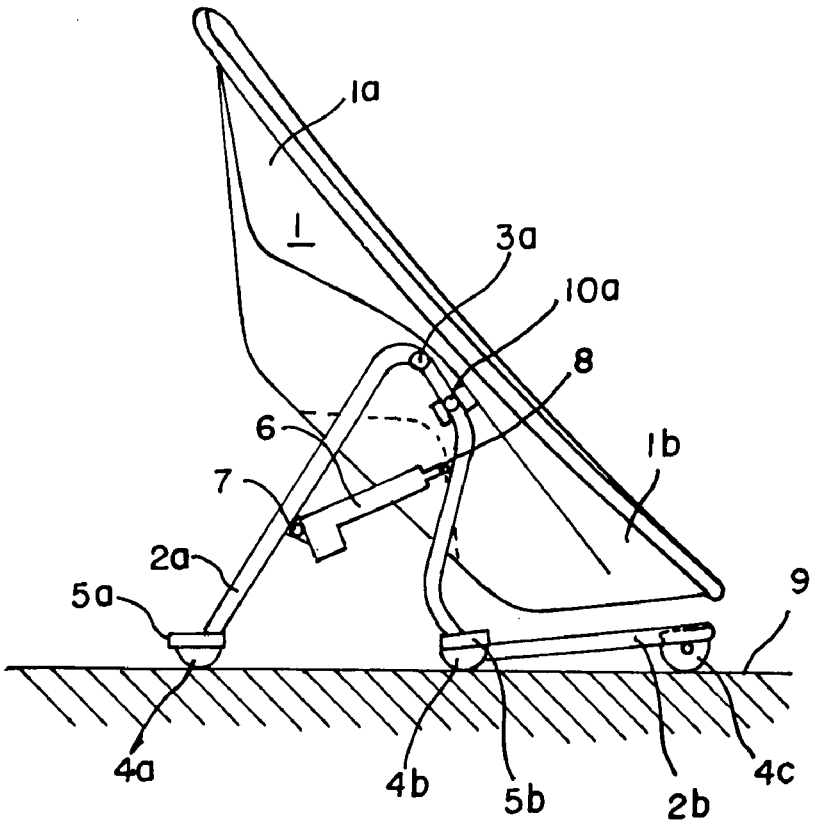
FIG. 2 shows schematically the tub arrangement according to FIG. 1 in a sitting position.

FIG. 2 shows schematically the tub arrangement according to FIG. 1, where the tub 1 has been turned into a sitting position. In this position, it is easy to step into the tub 1, whereafter the tub can be turned into a suitable position for a bath. The tub 1 can be changed from one position to another in two different manners. Firstly, the horizontal position shown in FIG. 1 can be changed into the sitting position shown in FIG. 2 by locking the wheels 4*a* as described above, and by shortening the distance between the connecting points 7 and 8 by the power element 6. Furthermore, the sitting position shown in FIG. 2 can be changed back into the horizontal position shown in FIG. 1 by locking the wheels 4*a* as described above and by lengthening the distance between the connecting points 7 and 8 by the power element 6. In the second manner, the horizontal position shown in FIG. 1 is converted into the sitting position shown in FIG. 2 by locking the wheels 4*b* as described above and by shortening the distance between the connecting points 7 and 8 by the power element 6. Furthermore, in the second manner the sitting position shown in FIG. 2 is reconverted into the horizontal position shown in FIG. 1 by locking the wheels 4*b* as described above and by lengthening the distance between the connecting points 7 and 8 by the power element 6.

Figure 3A:
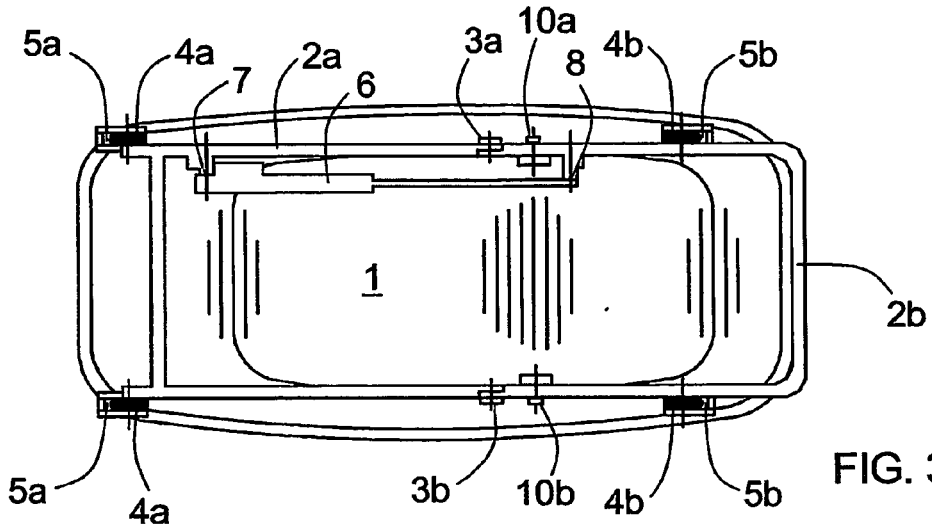
FIGS. 3*a*, 3*b* and 3*c* are schematic bottom views of different embodiments of the tub arrangement according to the invention.
Figure 3B:
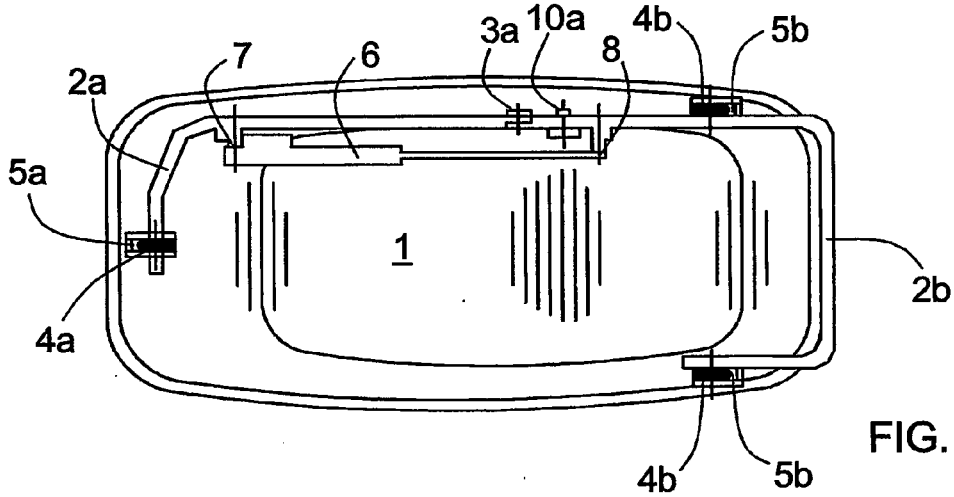
Figure 3C:
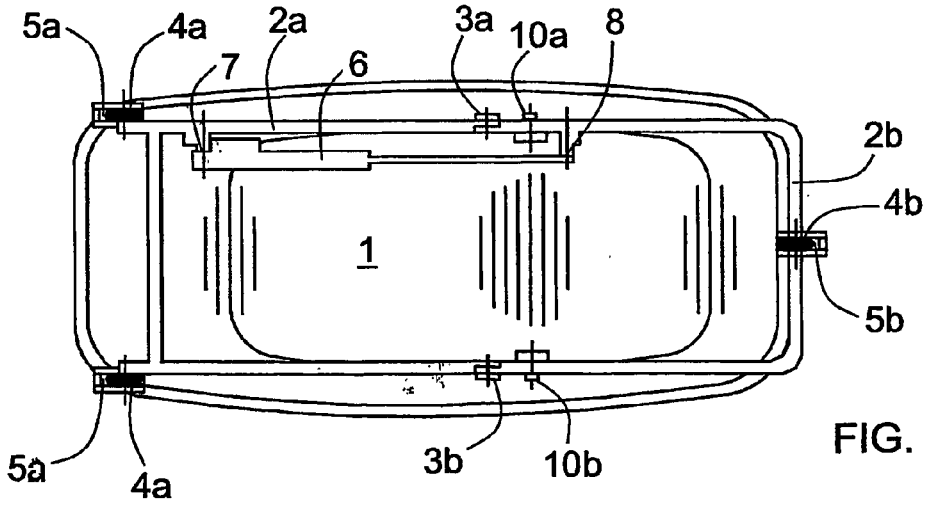

FIGS. 3*a*, 3*b* and 3*c* are schematic bottom views of different embodiments of the tub arrangement according to the invention.

Figure 5:
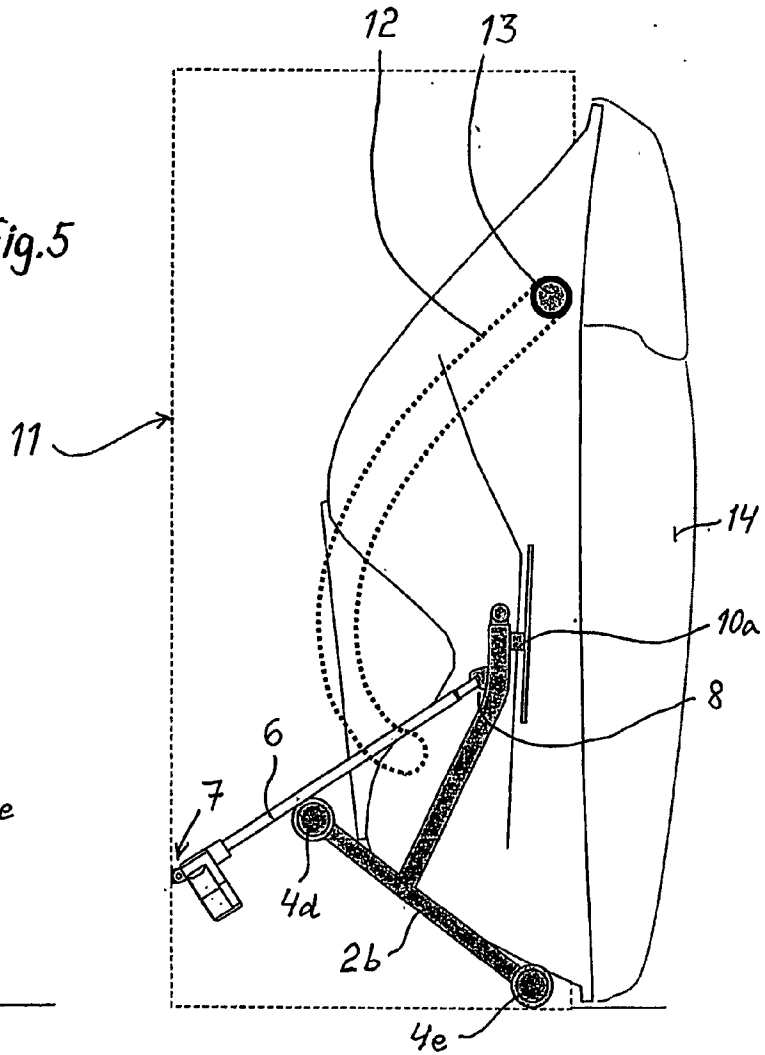
FIG. 5 shows into a closet placed tub arrangement in a vertical position.
Figure 4:
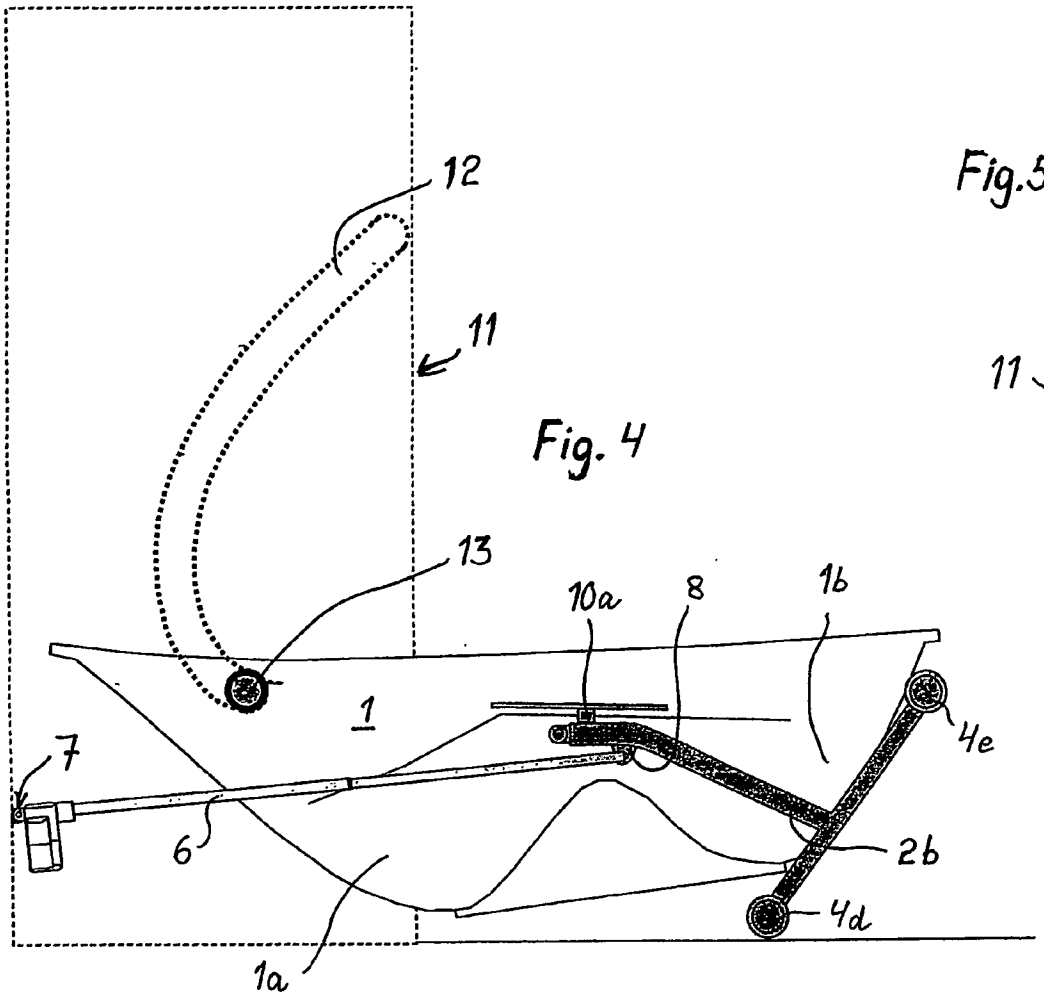
FIG. 4 shows into a closet placed tub arrangement in a horizontal position.

In the FIG. 4 there is a tub arrangement, as one leg parts 2*b* of which are against floor placed legs which are equipped with wheels 4*d*, 4*e*. The leg part 2*b* has been firmly fixed to the tub by means of a part 10*a*. The turning motions for the tub are done by means of power element 6, one fixing point 8 of which locating in a leg 2*b* and the other fixing point 7 on a wall of the closet 11. There on the closet wall has been arranged a curved rail 12 and a roll 13 rolling along rails 12 has been fixed to the tub, wherein the power element 6 pulls the fixing points 7 and 8 nearer to each other, the tub turns into vertical position and moves into the closet 11, as described in FIG. 5. When the power element is lengthening the distance between the fixing points 7,8, the tub is turning into horizontal position, as it is in FIG. 4. The leg 2*b* has been equipped with two successive wheels 4*d*, 4*e*, wherein the lower end of the tub is easily moving in whole moving range when it is lifted up.

The invention is described in the above specification and in the drawings only by way of an example, and it is not restricted thereto in any way. Therefore, the structures of the leg sections 2*a* and 2*b* can vary, as long as the tub 1 can be turned into the required positions. The number of the wheels 4*a* and 4*b* is not restricted to the aforementioned four wheels, either, but the number thereof must be substantially sufficient to keep the tub arrangement firmly upright on the push surface 9. Moreover, the leg sections 2*a* and 2*b* can be anchored for example to the push surface 9 or to a wall surface by different anchoring means, such as hooks, or the push surface 9, along which the tub arrangement according to the invention is being moved, can be provided with protrusions or recesses that prevent the wheels 4*a* and 4*b* from rotating.

The invention claimed is:

1. A tub arrangement comprising a seat section and an adjoining foot section, a pair of leg sections disposed substantially below said seat and foot sections, one of said leg sections being disposed substantially below said seat section and the other of said leg sections being disposed substantially below said foot section, said other sections being interconnected to said foot section and immoveable with respect thereto, wheels interconnected respectively to said leg sections opposite said interconnection, said leg sections being pivotally hinged together at a pointed spaced from said interconnection, a power element interconnecting said leg sections for adjusting the distance between a first connecting point on one of said leg sections and a second connecting point on the other of said leg sections, and said wheels being selectively lockable.

2. A tub arrangement according to claim 1 wherein said power element is a piston-type cylinder.

* * * * *